United States Patent [19]

Liberman

[11] 4,210,298

[45] Jul. 1, 1980

[54] ELECTRO-MECHANICAL GUIDANCE ACTUATOR FOR A MISSILE

[75] Inventor: Harold J. Liberman, Randolph, N.J.

[73] Assignee: The United States of America as represented by the Secretary of the Army, Washington, D.C.

[21] Appl. No.: 930,301

[22] Filed: Aug. 1, 1978

[51] Int. Cl.[2] ..... F42B 15/16

[52] U.S. Cl. ..... 244/3.21

[58] Field of Search ..... 244/3.21, 3.22, 3.15, 244/3.24; 114/23

[56] References Cited

U.S. PATENT DOCUMENTS

| | | | |
|---|---|---|---|
| 3,102,437 | 9/1963 | Geger | 244/3.21 X |
| 3,104,081 | 9/1963 | Arnett | 244/3.21 |
| 3,272,124 | 9/1966 | Marsh et al. | 244/3.21 |
| 3,355,130 | 11/1967 | Dell | 244/3.21 |
| 4,163,534 | 8/1979 | Seeger | 244/3.22 |

*Primary Examiner*—David H. Brown

*Attorney, Agent, or Firm*—Nathan Edelberg; Robert P. Gibson; Max Yarmovsky

[57] ABSTRACT

In flight guidance of a missile is provided by a plurality of orthogonally disposed wing panels which can be rotated by a self-centering biased torque producing lever-ball joint assembly. A plurality of solenoids, operatively positioned proximate to a rotary cam member, are individually selectively activated to engage the rotary cam member which inclines the torque producing lever-ball joint assembly and rotates the wing panels in a desired direction.

9 Claims, 5 Drawing Figures

ELECTRO-MECHANICAL GUIDANCE ACTUATOR FOR A MISSILE

GOVERNMENTAL INTEREST

The invention described herein may be manufactured, used in licensed by or for the Government for governmental purposes without the payment to me of any royalty thereon.

BACKGROUND OF THE INVENTION

Various means have been used in the prior art to guide non-spin stabilized missiles while in-flight toward their intended targets. A common means for accomplishing in flight guidance in the past has been to include adjustable fins, vanes or wing planes on the projectile. In the past pneumatic and hydraulic control mechanisims or several electric motors were used to control each pair of wing planes. The problem with the aforementioned devices has been that generally more than one pneumatic or hydraulic cylinders or electric motors were required to control a pair of wings. For a "cruciform" or "cross" wing pattern a minimum of 2 control pistons and cylinders or motors were required to obtain up-down and left-right wing movement. If roll control or differential wing movement was required, then usually a third piston-cylinder or motor was necessary. The problem with the prior art control devices was that because of the plurality of prime movers required they were complicated, expensive to manufacture and frequently used up an excessive amount of warhead allocated space. A plural piston cylinder combination requires expensive machinery and multi-electric motor design is more complex than a single motor control source.

SUMMARY OF THE INVENTION

The present invention relates to an in-flight electro-mechanical guidance activator for a non-spin stabilized missile. The present device utilizes a single electric motor in combination with a cam assembly and biased follower torquing means to selectively control the rotational direction of a pair of orthogonally disposed missle guiding wing vanes.

An object of the present invention is to provide an electro-mechanical in-flight guidance actuator for a missile which requires the use of only a single motor.

Another object of the present invention is to provide an electro-mechanical in-flight guidance actuator for a missile having a plurality of control vanes which is inexpensive to manufacture and simple of design.

A further object of the present invention is to provide an electro-mechanical in-flight guidance actuator for a missle having a plurality of wing vanes which can be actuated from a single electric motor and which utilizes a minimum of missile warhead volume.

For a better understanding of the present invention, together with other and further objects thereof, reference is made to the following descriptions taken in connection with the accompanying drawings.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
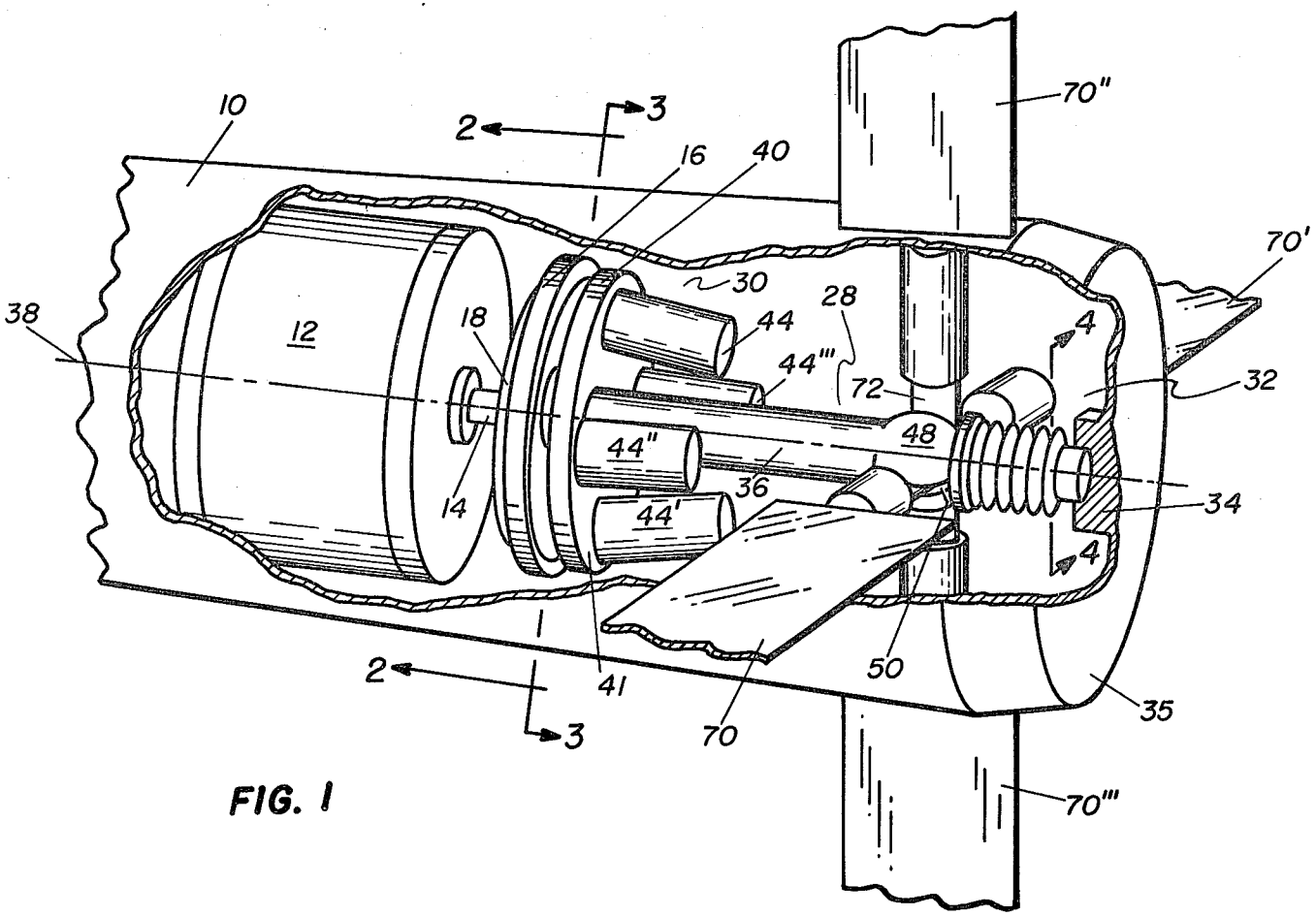
FIG. 1 is a cutaway isometric view of the in-flight guidance end of a missile having orthogonally disposed wing vanes.
Figure 2:
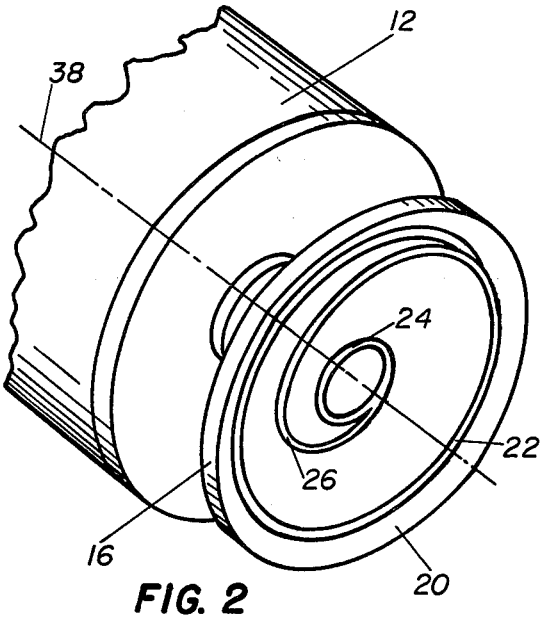
FIG. 2 is a partial isometric view of the prime mover and attached grooved cam member taken along line 2—2 of FIG. 1.
Figure 3:
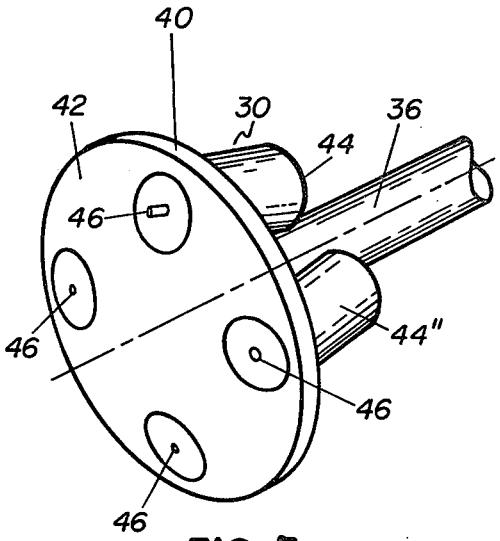
FIG. 3 is a partial isometic view of the solenoid cam-follow assembly taken along line 3—3 of FIG. 1.
Figure 4:
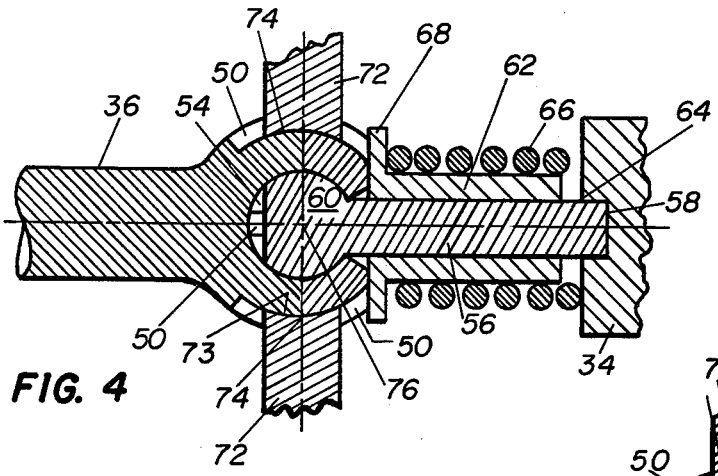
FIG. 4 is a partial cross-sectional view of the wing vane control joint taken along line 4—4 of FIG. 1 showing the guidance actuator in a vertical guidance position.
Figure 5:
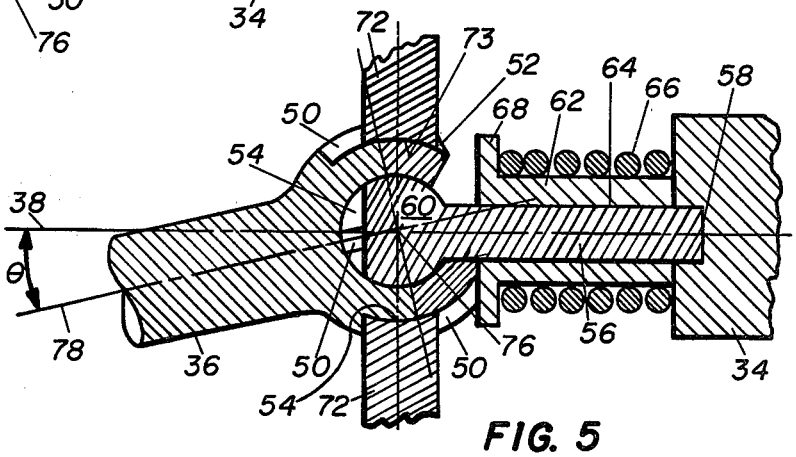
FIG. 5 is the same view as shown in FIG. 4 with the exception that the moment arm is inclined at an angle $\theta$ with respect to the longitudinal axis thereby causing a pair of wing shafts to rotate.

Referring now to FIG. 1-3 a tubularly shaped missile airframe 10 has an electric drive motor 12 axially disposed therein. The electric motor rotates at a constant speed in a clockwise direction when viewed from the line 2—2 of FIG. 1. Electric motor output shaft 14 is fixedly axially attached to a circular plate shaped cam member 16 at cam member convex rear end 18. The concavely shaped forward end 20 of cam member 16 has a concentrically positioned outer circular groove 22, and a concentrically aligned inner circular dwell groove 24 disposed therein. Grooves 22 and 24 are connected to each other by a spiral groove 26. As the cam member 16 is rotated in a clockwise direction an object placed in the spiral groove 26 is driven toward the inner dwell groove 24. A cantilever moment arm assembly 28 has a free cam follower assembly end 30 and a control ball joint assembly end 32, the latter being fixedly attached to a hub 34 located on interior wall of closed end 35 of airframe 10. When the moment arm assembly 28 is in its neutral, non-activated, position as shown in FIG. 1, moment arm shaft 36 is in axial alignment with the longitudinal axis 38 of air-frame 10. Cam follower assembly end 30 comprises a solenoid support disc 40 having a convex front end 42 having substantially the same radius of curvature as the concave surface of the cam member grooved froward end 20. A plurality of orthogonally disposed solenoids 44, 44', 44'', and 44''' are operatively fixedly positioned in the rear end of solenoid disc 40 so that solenoid pins 46 when extended by an actuated solenoid 44, 44', 44'', and 44''' will engage cam member grooves 22, 24 and 26. The rear end 41 of the solenoid support disc is fixedly attached and axially aligned with the moment arm shaft 36. The other end of moment arm shaft 36 terminates in a hollow partially round ball member 48 having orthogonally disposed torquing slots 50 therethrough and a flat front open end 52 as illustrated in FIGS. 4 and 5. Rotatably disposed within ball member ball cavity 54 is a cantilever anchor sting shaft member 56 having a fixed end 58 fixedly axially attached to air frame hub 34 and an inner ball shaped end 60 operatively slidably disposed in ball member cavity 54. An anchor collar member 62 is slidably disposed on the anchor sting shaft 64 intermediate hub 34 and the flat front end 52 of slotted hollow outer ball member 48. A helical centering spring 66 is biasedly positioned between an anchor collar flange 68 and airframe hub 34. The longitudinal axis of anchor sting member shaft 64 is in axial alignment with the longitudinal axis 38 of the airframe 10. A plurality of wing guidance panels 70, 70', 70'' and 70''' are rotatably disposed in airframe 10. Wing guidance panels 70, 70', 70'' and 70''' have rectangularly shaped wing shaft ends 72 which slidably pass through ball member torquing slots 50 and contoured on rear surface 73 to slidably rest against ball member circularly shaped end surface 74.

In operation, when an error signal from a guidance and control unit, not shown, of the missile energizes one of the aforementioned orthogonally disposed solenoids, a pin shaft 46 is pushed out of a solenoid engaging the outer groove 22 of the rotating cam member 16 and quickly enters the spiral groove 26 riding it toward the center inner dwell groove 24. When a solenoid pin shaft 46 is disposed in the dwell groove 24, the device is in one position of a plurality of guide positions. Depending on which solenoid is energized, the moment arm shaft 36 will pivot about an origin point 76 until the longitudinal axis 78 of the moment arm shaft 36 moves through an angle $\theta$ with respect to the longitudinal axis 38 of the airframe 10. Activation of upper vertically positioned solenoid 44 will cause a counter-clockwise torquing force to be applied to horizontal wing panels 70, 70' through their respective rectangulaly shaped shaft ends while leaving vertical wing panels 70'', 70''' stationary. Activation of the lower vertically positioned solenoid 44' will cause a clockwise torquing force to be applied to wing panels 70, 70' while leaving vertical wing panels 70'', 70''' stationary. In a similar fashion when the horizontal solenoids 44'' 44''' are separately activated, the vertical wing panels 70'' and 70''' can be rotated either in a clockwise or counter-clockwise direction while the horizontal wing panels 70, 70' will remain stationary. Rotation of wing panels 70, 70', or 70'' and 70''' will cause the missile to change its flight direction either up or down, or to veer to the left or right. When none of the solenoids are activated the front face of flange 68 of the spring loaded collar member 62 pushes against the corner of the front end 52 of ball member 48 forcing moment arm shaft 36 to pivot on ball end 60 and to automatically return to a neutral stable position as shown in FIGS. 1 and 4. In the neutral stable position the longitudinal axis 78 of the moment arm shaft 36 is axially aligned with the longitudinal axis 38 of the airframe 10 without any torquing force being applied to wing panels 70, 70' 70'' and 70'''. The spring pressure of collar flange 68 against the flat front end 52 of the ball member 48 tends to prevent any random movement of moment arm shaft 36 when the latter is in its neutral position and the torquing slots 50 of ball member 48 tend to lock the wing panels in a fixed non-deflecting position.

While there has been described and illustrated specific embodiments of the invention, it will be obvious that various changes, modifications and additions can be made herein without departing from the field of the invention which should be limited only by the scope of the appended claims.

Having thus fully described the invention, what is claimed as new and desired to be secured by Letters Patent of the United States is:

1. An electro-mechanical actuator for in-flight guidance of a missile toward a target which comprises:

a tubularly shaped missile airframe having a longitudinal axis therethrough and an axially disposed hub located on an interior rear wall of said missile airframe;

prime mover means for generating a unidirectional constant torque output, said prime mover means having a longitudinal axis axially aligned with said longitudinal axis of said missile airframe;

cam means fixedly axially connected to said prime mover means for changing from a neutral guide position to a plurality of selected guide positions;

electro-mechanical solenoid means for mechanically engaging said cam means upon receipt of an energizing electrical signal;

cantilever moment arm means, axially supported in said missile airframe, for operatively positioning said solenoid means proximate to said cam means, and for converting said unidirectional constant torque output of said prime mover means to a multi-orthogonal torque output;

vane means rotatably disposed in said missile airframe and cooperatively slidably connected to said cantilever moment arm means, for guiding said missile toward the target; and biased control means, axially disposed intermediate said hub and a first end of said cantilever moment arm means, for providing rotatable support for said first end of said cantilever moment arm means and for providing a spring force to automatically maintain and return to a neutral guide position from a guide position when said solenoid means is not receiving said energizing electrical signal.

2. An electro-mechanical actuator as recited in claim 1 wherein said prime mover means comprises:

an electric motor having a motor output shaft operatively coupled to said cam means.

3. An electro-mechanical actuator as recited in claim 2 wherein said cam means comprises:

a circular plate shaped cam member having a convex rear end fixedly axially attached to said motor output shaft, a concavely shaped forward end having an outer circular groove concentrically aligned with said motor output shaft, a concentrically aligned inner circular dwell groove, and a spiral grooved disposed therebetween and communicating therewith.

4. An electro-mechanical actuator as recited in claim 3 wherein said solenoid means comprises a plurality of electric solenoids operatively orthogonally disposed on a free end of said cantilever moment arm means, said plurality of electric solenoids when actuated having pin shafts aligned to extend toward said concavely shaped forward end of said cam member and to operatively enter into said outer circular groove.

5. An electro-mechanical actuator as recited in claim 4 wherein said cantilever moment arm means comprises:

a moment arm shaft having a cam follower assembly means disposed on a free end and hollow ball joint means operatively disposed on a rotatable fixed end.

6. An electro-mechanical actuator as recited in claim 5 wherein said cam follower assembly means comprises a solenoid support disc member having a convexly shaped front end having a radius of curvature substantially the same as a radius of curvature of said concavely shaped forward end of said cam member, said solenoid support disc member fixedly axially attached to said free end of said moment arm shaft.

7. An electro-mechanical actuator as recited in claim 6 wherein said hollow ball joint means comprises:

a ball member having orthogonally disposed torquing slots therethrough, a spherically shaped ball cavity centrally located therein and flat front open end, said flat front open end being in abutment with said biased control means, said vane means slidably disposed in said orthogonally disposed torquing slots.

8. An electro-mechanical actuator as recited in claim 7 wherein said vane means comprises a plurality of orthogonally disposed wing guidance panels, each of said wing guidance panels being rotatably supported in said airframe and having a rectangularly shaped wing shaft slidably disposed in said orthogonally disposed torquing slots.

9. An electro-mechanical actuator as recited in claim 8 wherein said biased control means comprises:

a cantilever anchor sting shaft member having a first end fixedly attached to said hub and a second inner ball shaped end rotatably disposed in said spherically shaped ball cavity of said ball member, an anchor collar member slidably disposed on said anchor sting shaft member intermediate said hub and said flat front open end of said ball member; and a biased helical centering spring slidably disposed on said anchor collar member between one end of said anchor collar member and said hub of said missile airframe.

* * * * *